United States Patent [19]

Stahlecker

[11] Patent Number: 4,570,435

[45] Date of Patent: Feb. 18, 1986

[54] FIBER FEED CHANNEL ARRANGEMENT FOR AN OPEN-END FRICTION SPINNING MACHINE

[75] Inventor: Fritz Stahlecker, Bad Überkingen, Fed. Rep. of Germany

[73] Assignees: Hans Stahlecker; Fritz Stahlecker, both of Fed. Rep. of Germany

[21] Appl. No.: 647,237

[22] Filed: Sep. 4, 1984

[30] Foreign Application Priority Data

Sep. 14, 1983 [DE] Fed. Rep. of Germany ..... 3333051

[51] Int. Cl.[4] ..... D01H 7/882

[52] U.S. Cl. ..... 57/401; 57/88; 57/105; 57/406; 57/407

[58] Field of Search ..... 57/1 R, 400, 401, 406, 57/407, 88, 105

[56] References Cited

U.S. PATENT DOCUMENTS 3,375,649 4/1968 Bures et al. ..... 57/407
3,874,154 4/1975 Stahlecker et al. ..... 57/407
4,202,163 5/1980 Turk et al. ..... 57/411 X
4,380,892 4/1983 Parker et al. ..... 57/401

*Primary Examiner*—John Petrakes
*Attorney, Agent, or Firm*—Barnes & Thornburg

[57] ABSTRACT

An open-end friction spinning machine is disclosed having a plurality of spinning units which each include adjacently arranged rollers driven in the same rotational direction and forming an accessible wedge-shaped yarn forming gap. A fiber inlet and opening device is provided for opening fiber material to be spun. A fiber feed channel connects to the inlet and opening device and has its fiber feed outlet opening to the yarn forming gap. The yarn withdrawal device draws off the produced yarn in the longitudinal direction of the yarn forming gap. Each spinning unit is provided with a channel carrier removable for the exposure of the yarn forming gap, which channel carrier forms at least one portion of the fiber feed channel containing the fiber feed outlet opening of the same. The channel carrier is adjusted in its operational position by means of centering means with respect to both the inlet and opening device and the bearing housing for the friction rollers.

21 Claims, 4 Drawing Figures

FIBER FEED CHANNEL ARRANGEMENT FOR AN OPEN-END FRICTION SPINNING MACHINE

BACKGROUND AND SUMMARY OF THE INVENTION

The invention relates to an open-end friction spinning machine with a plurality of adjacently arranged spinning units which respectively include two adjacently arranged rollers driven in the same rotational direction and forming an accessible yarn forming wedge-shaped slot or gap. The open-end friction spinning machine is also provided with a fiber inlet and opening device for fiber material to be spun. A fiber feed channel extends from the inlet and opening device to a fiber feed opening opposite the wedge-shaped gap. A yarn withdrawal device is provided for drawing off the produced yarn in the longitudinal direction of the wedge-shaped gap.

The spinning machines of this type commonly known include a plurality of similarly operating, adjacently arranged spinning units disposed preferably on both sides of the machine. Open end friction spinning machines of this type are designed in accordance with similar basic principles whereby it is a practical demand to design the machine in such a manner that the wedge-shaped gaps formed by the adjacently arranged roller pairs of each spinning unit respectively are made accessible for maintenance purposes, for example, to examine the rollers after a yarn break and, if necessary, to eliminate the cause for the yarn break.

With a known apparatus or device having only one spinning unit as disclosed in published Unexamined European Pat. application (EP-OS) 52 412 it is provided that the wedge-shaped gap is only partially exposed. The fiber feed channel positioned with its opening opposite the wedge-shaped gap is stationarily positioned within a housing with known construction. One of the two rollers is movably borne so as to allow its relocation away from the fiber feed channel and the other roller. Thereby the wedge-shaped gap and a portion of the opening of the fiber feed channel is made accessible for an inspection and/or maintenance process. The accessibility not only to the wedge-shaped gap but also to the fiber feed channel is not very good with this arrangement. In addition to that, retention of the desired narrow tolerance in the site of the wedge-shaped gap between the two rollers is made essentially more difficult since one of the rollers is movably arranged. Such a device or arrangement was generally determined to be too expensive, and also inconvenient for a maintenance process, in order to be meaningfully used in a series machine.

The invention is based upon the problem to construct a spinning unit for an open end friction spinning machine which, on the one hand, can be efficiently maintained and, on the other hand, retains an exact arrangement of the most essential individual operating elements without making unnecessarily high demands on tolerances to be followed by the manufacturer.

This problem is thereby solved in accordance with the invention by providing that each of the spinning units includes a fiber feed channel carrier, movably arranged for exposing the wedge-shaped gap, which channel carrier forms at least one portion of the fiber feed channel extending between the fiber inlet and opening device and containing the fiber feed opening of the same wherein the fiber feed channel carrier while in operational position is adjustable by means of a centering means with respect to the inlet and opening device and also with respect to the bearing housing holding the two rollers. It is achieved with this arrangement of the invention that, on the one hand, the wedge-shaped gap is readily accessible by removing the channel carrier whereby not only the wedge-shaped gap, but also the opening of the fiber feed channel is made accessible for a maintenance procedure and especially for a cleaning procedure. With the arrangement of the invention the channel carrier is that constructional element of a spinning unit with respect to which the functionally essential elements are adjusted by means of the centering means, so that one can obtain the specified operational conditions at any time by returning the channel carrier to its operational position. The manufacture of the holders of these individual elements does not require a high tolerance level so that a series manufacture and the assembly of a series machine is made essentially easier. The channel carrier is the central element to which the other interacting elements are adjusted to when closing the spinning unit.

In order to remove the channel carrier without disturbing the operation of the neighboring spinning units, one preferred embodiment of the invention provides that the channel carrier is retained by a pivoting holder pivotable about an axis extending in the longitudinal direction of the machine. It is thereby especially advantageous according to certain preferred embodiments that the holder consists of a cover like element serving as a cover piece for each of the spinning units. The holder thereby has an additional function of serving as a covering for the machine parts.

In certain preferred embodiments of the invention it is provided that the channel carrier is detachably arranged at a center plate affixed to a holder in an adjusted position by means of a fitting connection. It is thereby possible to exchange the channel carrier with the channel element containing the fiber feed opening without making any other adjustments, in order to, for example, obtain more favorable spinning conditions for different fiber material to be spun.

In certain preferred embodiments of the invention, it is provided that the inlet and opening device includes a housing for the opening roller which is pivotable about an axis extending essentially perpendicular to the axis extending in the longitudinal direction of the machine. A drive wharve of the opening roller is thereby selectively detachable from the drive belt. The channel carrier in the operational position is disposed with a guide face engageable with a counterpart of the opening roller housing to hold the same against the force of a spring in the operational position of said opening roller housing. It can thereby be attained that the operation of the opening roller is interrupted when the spinning unit is opened and the wedge-shaped gap is exposed. Furthermore, by the choice of the swivel axles of the holder and the housing of the opening roller, it is assured that the force with which the housing of the opening roller is loaded out of its operational position has become effective with only a minor movement in the opening direction of the channel carrier.

In a further arrangement of preferred embodiments of the invention, it is provided that between the channel area and the bearing housing, centering means are arranged which adjust the distance of the opening of the fiber feed channel and the relative position of the same to the wedge-shaped gap. A high degree of accuracy in the adjustment of the two structural elements is thus assured.

In a still further arrangement of the invention it is provided that the bearing housing of each spinning unit is stationarily arranged at the machine frame by insertion of elastical spring means. It is thereby attained, that the rollers do not change their position when the spinning unit is opened so that they are well accessible for a cleaning procedure, especially for procedures utilizing an automatic cleaning device. Further, it is facilitated that the bearing housing with the rollers is adjusted to a very minor degree against the channel carrier. It is especially advantageous if in further features of the invention, the bearing housing of each spinning unit is supported at the machine frame by means of one or several rubber elastic blocks. Thereby, not only the possibility of adjustment in each of the possible degrees of freedom is facilitated, but also a vibration damping, and thereby also a noise damping is obtained.

According to further advantageous features of certain preferred embodiments of the invention it is provided that the bearing housing is positioned upon screw bolts of the machine frame by means of keyhole-like recesses. It is thereby possible to dismantle the bearing housing as a whole together with the respective rollers, if such becomes necessary.

According to yet another preferred advantageous feature of certain preferred embodiments of the invention, it is provided that the operational position of the channel carrier is secured by means of a detachable locking device. It is thereby achieved that the channel carrier always remains in the same operational position so that all other interacting and cooperating additional structural elements will remain in the same position.

According to another feature of the invention it is provided that the locking device includes a control lever connected to a device for interrupting the drive of the rollers and/or for braking the rollers. It is thereby attained that when opening the locking device in order to provide access to the spinning unit, the drive of the rollers is interrupted or the rollers are braked so that any danger of injury to the servicing person by the exposed rollers is avoided.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figure 1:
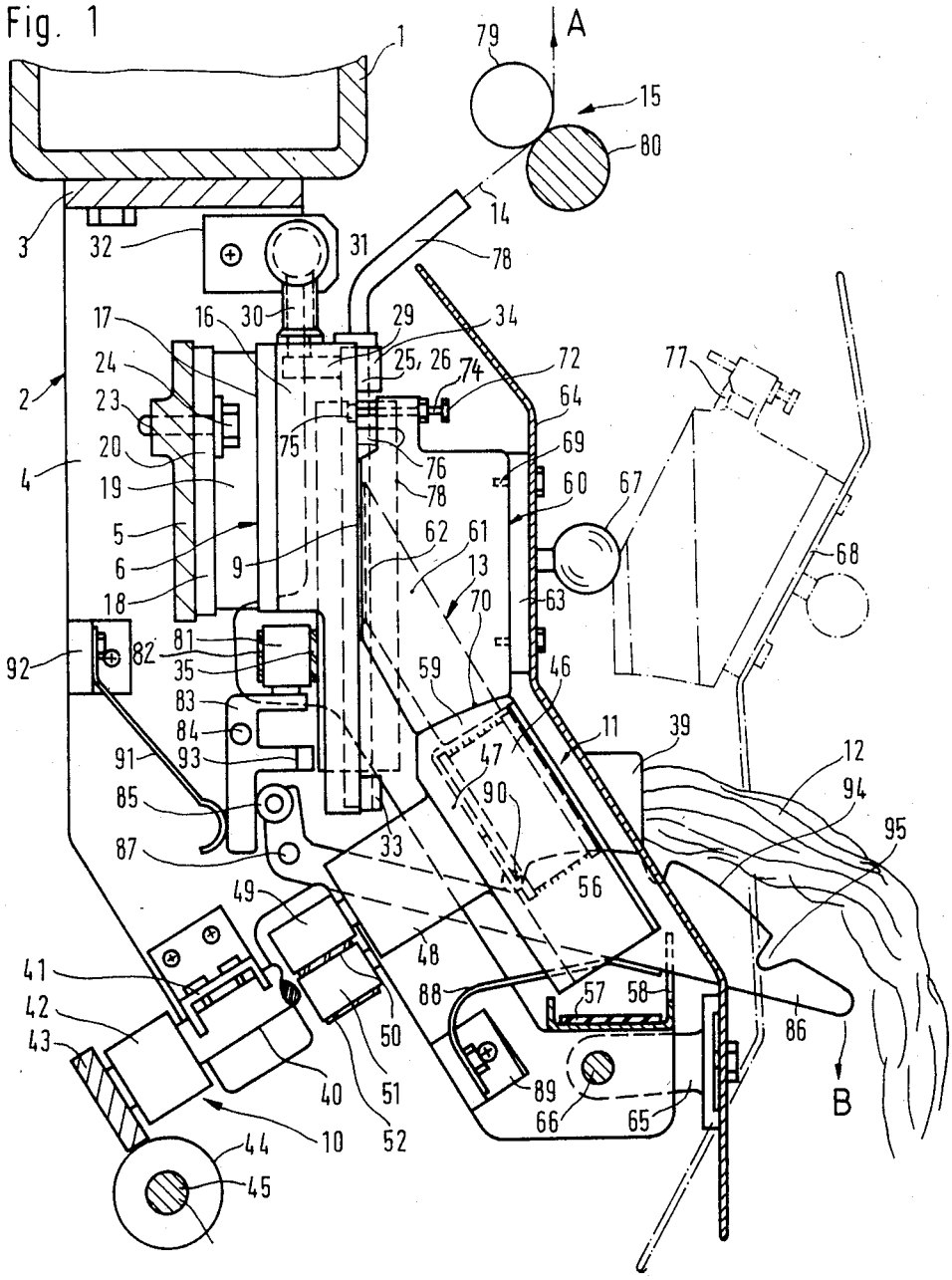
FIG. 1 is a partial side schematic part sectional view showing a machine for open end friction spinning constructed in accordance with a preferred embodiment of the invention.

In order not to obscure the invention, in the drawings and in the following description only those portions of an open-end friction spinning machine are shown and described as are deemed necessary for one skilled in the art to understand the present invention.

With the spinning unit for open-end friction spinning shown in FIG. 1, a fiber band or sliver 12 is introduced into a fiber inlet and opening device 11, wherein the fiber sliver 12 is opened into single fibers. The fibers are supplied via a fiber feed channel 13 to the area of a wedge-shaped gap 9 between two friction rollers 7 and 8 driven in the same rotational direction. Yarn 14 is produced in gap 9 from the single fibers and is drawn off via a yarn withdrawal device 15. Yarn 14 feeds through a bent yarn withdrawal pipe 78 which with its one end extends first in the direction of the extension of wedge-shaped gap 9 and then bends in the direction of the yarn withdrawal device 15. Following the yarn withdrawal device 15 extending in the yarn direction A, a spooling device is arranged which is described in no further detail here, with which the yarn 14 is taken up by a spool. The two rollers 7 and 8 of each of the spinning units are vertically arranged so that the wedge-shaped gap 9 also extends in the vertical direction. The fiber inlet and opening device 11 is arranged in front of and below the rollers 7 and 8 in such a manner that the fiber feed channel 13 starts about tangentially at the opening roller 46 of the fiber inlet and opening device 11, and extends in a straight line to the wedge-shaped gap 9. The fiber feed channel 13 thereby essentially is disposed in the plane of the wedge-shaped gap 9 (plane between rollers 7 and 8 extending transversely to the plane through the axles of the rollers 7 and 8). The rotational axis of opening roller 46 extends diagonally to the machine longitudinal direction with an inclination of about 45° to the horizontal plane.

In FIG. 1, only a carrier profile 1 of the machine frame of the open end friction spinning machine is shown, the same preferably consisting of a closed square carrier which extends in the longitudinal direction of the machine. Adjacently arranged single spinning units are attached to the carrier profile 1. For each spinning unit, a U-shaped carrier element 2 is attached from below to the carrier profile 1 by means of screws so that the cross-bar 3 of carrier element 2 extending in the longitudinal direction of the machine is affixed from below at the carrier profile 1. The cross bar 3 connects two side cheeks or side support bars 4 at which the individual elements of the spinning units are attached.

Figure 3:
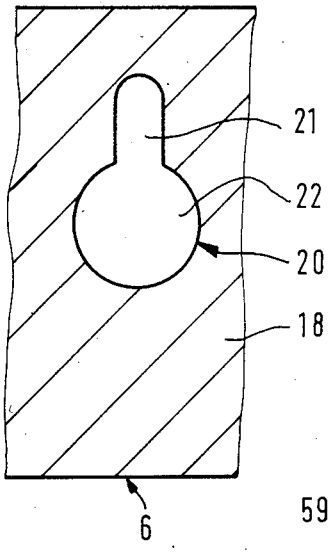
FIG. 3 is an enlarged top view of a portion of the bearing housing from the machine illustrated in FIG. 1.

Between the two side support bars 4 of the carrier element 2, a plate-shaped cross bar 5 is arranged pointing with its narrow edges to above and below to which a bearing housing 6 of roller 7 and 8 is affixed. The bearing housing 6 includes a housing part 16 with a plate-shaped backwall 17 connected via a single or several rubber blocks 19 (or rubber plates) by means of a fastening plate 18. This connection is made preferably by means of vulcanizing. The fastening plate 18 with its surface is attached to cross-bar 5 and affixed thereto by means of preferably two fastening screws 23 which are screwed into threaded bores of the cross bar 5. The fastening plate 18 (FIG. 3) includes a lock washer and a keyhole-like recess 20 which consists of a circular part 22 having a diameter greater than the head 24 of screw 23. A groove-shaped part 21 connects on top of the circular part 22, the width of which part 21 corresponds to the diameter of the fastening screw. In order to dismount a bearing housing 5 and to again assemble it, the fastening screws 23 are only to be loosened to allow the bearing housing 6 to be moved upwardly so as to remove the same above the heads 24 of the fastening screws 23.

Figure 2:
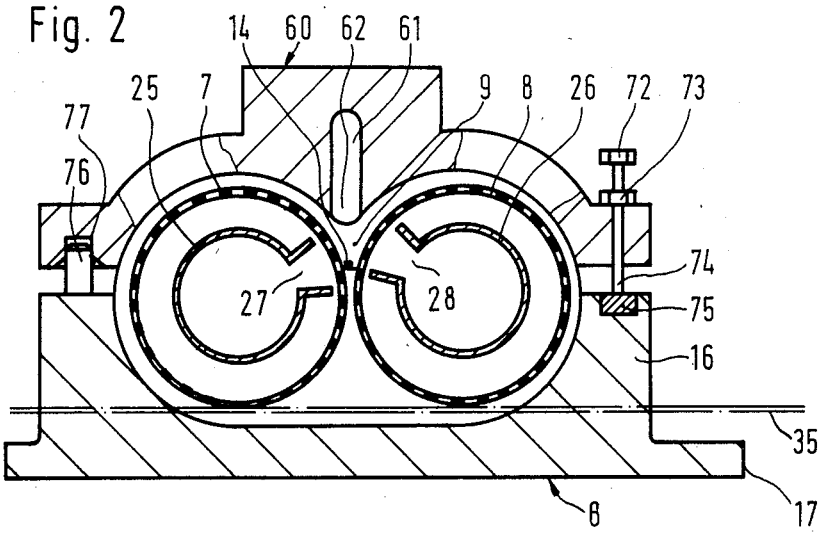
FIG. 2 is an enlarged cross-sectional view through a bearing housing for the friction rollers forming a wedge-shaped gap from the machine illustrated in FIG. 1.

The housing part 16 of bearing housing 6 includes receptacles into which two vertically extending pipes or tubes 25 and 26 are clamped by means of tension fasteners 33 and 34. Rollers 7 and 8, arranged as cylindrical covers or mantle pieces, are borne directly upon these tubes 25 and 26 by means of roller bearings. The cover pieces of rollers 7 and 8 include perforations at least in the area of the mouth 62 of the fiber feed channel 13. Tubes 25 and 26 are closed at their end faces and are connected via cross bores 29 of housing part 16 and connecting means 30 to an underpressure pipe 31 which extends in the machine longitudinal direction and is held by means of holders 32 to the side support bases 4. Tubes 25 and 26 (see also FIG. 2) are provided at least in the area of the mouth 62 of the fiber feed channel 13 with slit openings 27 and 28 extending in the direction of the wedge-shaped gap 9, which slit openings are defined by protrusions extending from up to close to the cover surfaces of rollers 7 and 8. With these measures, an under pressure is produced in the area of wedge-shaped gap 9 by means of which the single fibers are sucked into and the producing yarn 14 is held in the wedge-shaped gap 9.

As can be seen from FIG. 1, rollers 7 and 8 (as well as the tubes 25 and 26) extend downwardly beyond the area of the mouth 62 of fiber feed channel 13. In this lower area in which the cover surface of rollers 7 and 8 are no longer perforated a tangential belt 35 engages directly against the cover surfaces of rollers 7 and 8 on the side diametrically opposite the fiber feed channel 13. The tangential belt 35 extends in the longitudinal direction of the machine and drives the spinning units on one side of the machine. Belt 35 is pressed against the rollers 7 and 8 by means of a tension roller 81 arranged in the area of the rollers 7 and 8, preferably in the area of the wedge-shaped gap 9. The reverse run 82 of tangential belt 35 is guided on the same tension roller 81. The tension roller 81 is positioned on a holder 83 pivotably supported about a swivel axle extending approximately in the longitudinal direction of the machine, which holder 83 is attached against the effect of a plate spring 91 to a side support bar 4 by means of a holder 92. The tension roller 81 is held in the operational position by means of a roller 85 acting against spring 91. Roller 85 is arranged by means of a control lever 86 for movement about a pivot axis 87 extending in the longitudinal direction of the machine. The roller 85 is held in the so-described operational position by means of a plate spring 88 which is fixedly attached to a side support bar 4 by means of a holder 89. If the control lever 86 is moved along arrow direction B, the plate spring 91 swivels the holder 83 in such a manner (counter-clockwise about axle 84) that the tension roller 81 is moved away from the cover surfaces of rollers 7 and 8 so that the tangential belt 35 at least is somewhat less strained. The holder 83 further includes a brake with which the rollers 7 and 9 are slowed down. For this purpose, a second arm of the holder 83 is provided with a brake-covering 93 extending in the machine longitudinal direction over both of rollers 7 and 8, or respective separate brake coverings are provided for each roller 7 and 8. The arm holder 83 carrying the brake cover 93 is arranged in relation to the arm carrying the swivel axle 84 and the tensioning roller 81 in such a manner that both arms perform opposite motions relative to rollers 7 and 8 when pivoted. By switching the control lever 86, thereby not only the drive of rollers 7 and 8 is interrupted, but also a braking of rollers 7 and 8 occurs.

Figure 4:
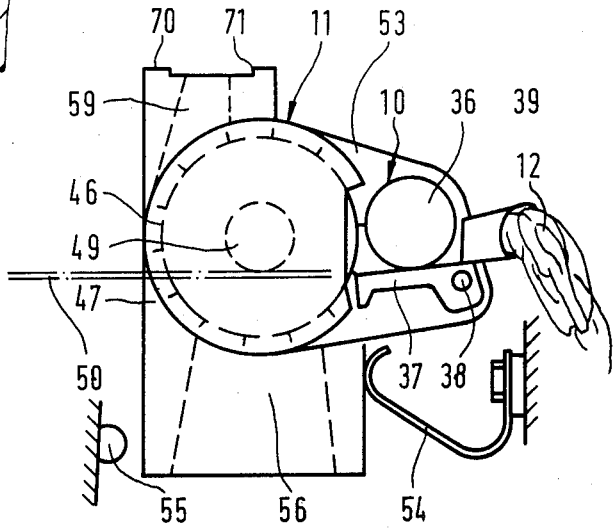
FIG. 4 is a top view of the fiber inlet and opening device of the spinning unit according to FIG. 1.

The inlet and opening device 11 includes a fiber feed roller 36 which forms a nip line for the fiber sliver 12 supplied via a feeding hopper together with a pivotable feed table 37 resiliently pressed against the roller 36 (FIG. 4). The fiber feed roller 36 and the feed table 37 offer the fiber sliver 12 in the form of a fiber beard to the opening roller 46. The circumference of roller 46 contains a set of saw teeth or needles which combs out the fiber beard 12 and thereby opens the same to single fibers. The shaft or spindle of feeding roller 36 is arranged inside of a pipe 40 which is fixed to one of the side support bars or plates 4 of the carrier element 2 by means of holders 41. The shaft or spindle of the feed roller 36 is connected via an electromagnetic coupling 42 to a screw wheel 43 which intermeshes with a screw wheel 44 which is arranged upon a spindle 45 extending in the longitudinal direction of the machine. The coupling 42 is controlled in a known manner by a not further described catch thread device arranged for example following the yarn withdrawal pipe 78 in such a manner that when a yarn break occurs, the fiber supply is interrupted by disengaging the drive of fiber feed roller 36.

The opening roller 46 is arranged in a housing 47 which includes a catch 53 pivotably located upon the pipe 40 surrounding the spindle of the fiber feed roller 36, so that the opening roller housing 47 pivots the axis of the fiber feeding roller 36. A bearing housing 48 for the drive shaft of opening roller 46 is connected to opening roller housing 47, which drive shaft contains a drive wharve 49 at its end protruding from the bearing housing 48. The drive wharve 49 is driven by means of a tangential belt 50 extending through in the longitudinal direction of the machine and is loaded in the area of the same with a pressure roller 51 held preferably in a spring like manner which also guides the return run 52 of tangential belt 50.

A plate spring 54 (FIG. 4) is attached to the carrier part 2 and rests against the opening roller housing 47 and loads the same in the direction of the tangential belt 50. The pivot distance of the opening roller housing 47 is restricted to a relatively low distance by means of a stop 55 which is so dimensioned that the drive wharve 49 of opening roller 46 is moved just about above the tangential belt 50 through this pivot motion. In the area of the circumference of the opening roller 46, a dirt removal opening 56 is arranged in the opening roller housing 47, which opening is opened at the bottom and through which dirt particles contained in the fiber material exit. Underneath the dirt removal opening 56, a dirt conveyor belt 57 (FIG. 1) extending in the machine longitudinal direction in a trough 58 and thereby transports the segregated impurities. The trough 58 is provided in the area of the control lever 86 with slit-shaped recesses.

The opening roller housing 47 further includes a first portion 59 of the fiber feed channel 13 extending upwardly, which continues via a second part 61 at a movable channel carrier 60. The portion 61 of channel carrier 60 includes the opening 62 of the fiber feed channel 13, which opening 62 is disposed opposite wedge-shaped gap 9. Carrier 60 is adjustably held in a position with mouth 62 preferably extending parallel to the wedge-shaped gap 9. The opening 62 extends slit-shaped in the longitudinal direction of the wedge-shaped gap 9.

The channel carrier 60 is affixed via a center plate 63 to a cover 64 formed as a swivel holder, which cover 64 is pivotably borne by means of a fastening element 65 about a pivot axle 66 extending in the longitudinal direction of the machine beneath the inlet and opening device 11. The center plate 63 is fixedly attached to cover 64 by means of screws in a predetermined position, whereby the screws are advantageously subsequently sealed. The channel carrier 60 itself is held at the center plate 63 by means of not further shown screws and a fitting connection, for example, fitting bolts 69 and corresponding fitting bores. The channel carrier 60 is therefore fixedly attached and interchangeably held in a predetermined position at the center plate 63 so that the same after an exchange resumes exactly the predetermined position without any adjustment effort. The cover 64 includes a control lever 67 which is arranged in the area of the center plate 63. As can be seen from FIG. 1, in which the open position 68 of the spinning unit is indicated in dotted lines, the spinning unit is generously exposed whereby through movements of the channel carrier 60, the area of the wedge-shaped gap 9 and the rollers 7 and 8 is made accessible while at the same time cover 64 is removed. This cover 64 covers the area of the length (height) of the spinning unit from the region of the dirt conveyer belt 57 to the yarn withdrawal channel 78. Thereby, also the elements underneath the cover, especially the inlet and opening device 11, are made accessible for maintenance operations.

In order to adjust and maintain the desired spinning conditions, it is necessary that on the one hand, channel carrier 60 with the partial element 61 of the fiber feed channel 13 is adjusted to the partial element 59 of the opening roller housing 47, and more importantly that the fiber feed channel 13 with its opening 62 is exactly aligned with the wedge-shaped gap 9. It is thereby accomplished to exactly adjust the slit-shaped opening 62 of the partial element 61 of the fiber feed channel 13 not only with respect to the distance to the wedge-shaped gap 9, but also with respect to the direction of said wedge-shaped gap 9. This is accomplished by providing that the channel carrier 60, by means of adjusting means, is positioned during closing of the unit not only with respect to the bearing housing 6 of rollers 7 and 8, but also with respect to the opening roller housing 47.

The channel carrier 60 is arranged in an exactly predetermined position when pivoted back into its operational position. For this purpose roller 90 is provided at the cover 64, which roller 90 interacts with a locking means of the control lever 86. This locking means is loosened by pushing down the control lever 86 in the arrow direction B whereby at the same time rollers 7 and 8 are slowed down with the interruption of their drive. The control lever 86 is advantageously provided with a cam surface 94 upon which roller 90 is guided during the opening motion. Several fitting connections can thereby be provided in the cam surface 94 with corresponding recesses 95 into which roller 90 is locked into, these locking means advantageously are chosen so that the control lever 86 returns to its operational mode thereby switching on the drive of roller 7 and 8 when closing cover 64.

The channel carrier 60 is provided with a stop face at its side facing the opening roller housing 47 whereby said housing 47 includes a guidance 70 in the area surrounding the partial element 59 of fiber feed channel 13, said guidance being formed as a corresponding counterpart. It is thereby advantageous if at least one guide groove or guide rib 71 is provided in order to obtain also a positioning in direction laterally thereof. In order to adjust the distance between the channel carrier 60, which means between the opening 62 of the partial element 61 of fiber feed channel 13, and the wedge-shaped slot 9, the channel carrier 60 is provided with at least 2 adjusting screws 74 which are supported at the lockplate 75 of the bearing housing 6. By adjusting the screws 74 which include a head 72 and are screwed into a threaded bore of channel carrier 60, the distance can be exactly adjusted. The distance is then secured by means of a counterlock 73 screwed upon the adjustment screw 74. Additionally, adjustment bolts 76 are provided between the bearing housing 6 and the channel carrier 60 which position the wedge-shaped slot 9 in relation to the opening 62. These adjustment bolts 76 arranged at the housing parts 16 of bearing housing 6 protrude into guidances 7 of channel carrier 60 during locking of the spinning unit, said guidance having a sloped intake. Based upon a spring elastic arrangement of the housing part 16 of the bearing housing 6, an adjustment within the necessary limits is made possible without problems. Since the yarn withdrawal tube 78 is also arranged at the housing part 16 of bearing housing 6, the yarn withdrawal direction of the produced yarn 15 within the area of the wedge-shaped slot 9 is not altered by such an adjustment of the wedge-shaped gap 9 relative to the channel carrier 60.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. Apparatus for open-end friction spinning including a plurality of spinning units, at least one of the spinning units including:

driveable friction surface means defining a yarn formation zone, said friction surface means being drivably supported in housing means, fiber inlet and opening device means for opening fiber material to be spun, fiber feed channel means for feeding fibers from the fiber inlet and opening device means to the yarn formation zone, said fiber feed channel means including a fiber feed opening facing the yarn formation zone, a portion of the fiber feed channel means including the fiber feed opening being formed in a movable channel carrier means, said carrier means being selectively movable between an operational closed position and at least one open position with the yarn formation zone exposed for maintenance operations, centering means for adjustably positioning said channel carrier means with respect to both the housing means and the inlet and opening device means whereby return of said channel carrier means to its operational closed position returns the portion of the fiber feed channel carried thereby to its adjusted position with respect to the yarn formation zone and with respect to the inlet and opening device means, and yarn withdrawal means for withdrawing spun yarn from the formation zone.

2. Apparatus according to claim 1, wherein the channel carrier means is held by a channel carrier holder means pivotable about an axis extending in the longitudinal direction to the machine.

3. Apparatus according to claim 2, wherein the channel carrier holder means is formed as a cover means serving as a cover for a respective spinning unit.

4. Apparatus according to claim 2, wherein the channel carrier means is detachably mounted in an adjusted position by means of a fitting connection to a center plate affixed to the channel carrier holding means.

5. Apparatus according to claim 4, wherein the channel carrier holder means is formed as a cover means serving as a cover for a respective spinning unit.

6. Apparatus according to claim 1, wherein the inlet and opening device means includes an opening roller housing containing an opening roller, said opening roller housing being pivotably borne about an axis extending essentially transversely to the longitudinal direction of the machine, wherein a drive wharve of the opening roller is loosened from a drive belt during pivotal movement of the opening roller housing, wherein the channel carrier means is adjacently arranged with a stopping face at a counterpart of the opening roller housing in the operational mode, and wherein said counterpart is held in said operational mode against the force of a spring.

7. Apparatus according to claim 6, wherein the stopping face of the channel carrier means and/or the counter part of the opening roller housing is provided with guide ribs and grooves.

8. Apparatus according to claim 1, wherein the centering means includes centering means arranged between the channel carrier means and the housing means which adjust the distance of the fiber feed opening and the relative position of the fiber feed opening to the yarn formation zone.

9. Apparatus according to claim 8, wherein the centering means includes at least one adjustment screw between the channel carrier means and the housing means limiting the distance of channel carrier means and the fiber feed opening with respect to the yarn formation zone.

10. Apparatus according to claim 9, wherein the centering means includes at least one center bolt provided between the channel carrier means and the housing means which protrudes into recess means including an inlet guide for the movement to the channel carrier means into the operational position.

11. Apparatus according to claim 8, wherein the centering means includes at least one center bolt provided between the channel carrier means and the housing means which protrudes into recess means including an inlet guide for the movement to the channel carrier means into the operational position.

12. Apparatus according to claim 1, wherein the housing means of each of the spinning units is stationarily held at a machine frame by means of interconnecting elastic support means.

13. Apparatus according to claim 12, wherein the housing means of each of the spinning units is supported at the machine frame by one or several rubber elastic blocks forming the elastic support means.

14. Apparatus according to claim 13, wherein the housing includes a plate-shaped rear wall to which a fastening plate is attached by means of one or several elastic blocks forming the elastic support means, said fastening plate being mounted at the machine frame.

15. Apparatus according to claim 12, wherein the housing means is set upon threaded bolts at the machine frame by means of keyhole-like recesses.

16. Apparatus according to claim 1, wherein the operational position of the channel carrier means is secured by means of a detachable locking device.

17. Apparatus according to claim 16, wherein the locking device includes a control lever which locks into a device for the interruption of the drive and/or for braking the friction surface means.

18. Apparatus according to claim 1, wherein the driveable friction surface means comprises a pair of adjacently arranged friction rollers drivable in the same direction, and the yarn formation zone comprises a wedge-shaped gap between the pair of rollers.

19. Apparatus according to claim 18, wherein the friction rollers are driven by means of a tangential belt which is held against the friction rollers by means of a tension roller, said tension roller being arranged at a movable holder to be selectively removable from the friction rollers by an operating control lever.

20. Apparatus according to claim 19, wherein the friction rollers can be selectively braked by respective brakes operated by the control lever.

21. Apparatus according to claim 20, wherein the brakes and the tension roller are arranged on arms of a common swivel holder, which arms move against each other with respect to the friction rollers during swivel action.

* * * * *